US007283855B2

(12) United States Patent
Yamanaka et al.

(10) Patent No.: US 7,283,855 B2
(45) Date of Patent: Oct. 16, 2007

(54) DIELECTRIC WAVEGUIDE HAVING A 45° FACE AND METHOD OF PRODUCTION THEREOF

(75) Inventors: Kazunori Yamanaka, Kawasaki (JP); Akihiko Akasegawa, Kawasaki (JP); Masafumi Shigaki, Kawasaki (JP); Isao Nakazawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/647,237

(22) Filed: Aug. 26, 2003

(65) Prior Publication Data

US 2004/0041656 A1 Mar. 4, 2004

(30) Foreign Application Priority Data

Aug. 30, 2002 (JP) ..... 2002-255644

(51) Int. Cl.
*H01P 3/12* (2006.01)
*H01B 12/02* (2006.01)

(52) U.S. Cl. ..... 505/210; 333/239; 333/99 S; 333/249

(58) Field of Classification Search ..... 333/239, 333/99 S, 249; 505/210, 700, 701, 866
See application file for complete search history.

(56) References Cited

U.S. PATENT DOCUMENTS

| | | | | |
|---|---|---|---|---|
| 5,071,830 A | | 12/1991 | Olson et al. | 505/1 |
| 5,139,998 A | | 8/1992 | Eddy et al. | 505/1 |
| 5,512,539 A | * | 4/1996 | Matsuura et al. | 505/210 |
| 6,011,983 A | * | 1/2000 | Ishikawa et al. | 505/210 |
| 6,470,198 B1 | * | 10/2002 | Kintaka et al. | 505/210 |
| 6,602,622 B2 | | 8/2003 | Kintaka | 428/701 |
| 2002/0098986 A1 | | 7/2002 | Kintaka | 505/1 |

FOREIGN PATENT DOCUMENTS

| | | |
|---|---|---|
| JP | 02-175612 | 7/1990 |
| JP | 07-336113 | 12/1995 |
| JP | 52-20141 | 2/1997 |
| JP | HEI 10-139595 | 5/1998 |
| JP | 2001-127351 | 5/2001 |
| JP | 2002-057506 | 2/2002 |
| JP | 01-211872 | 8/2002 |
| JP | 2002-217460 | 8/2002 |

OTHER PUBLICATIONS

Y. Konishi; "The basis of microwave circuit and the application thereof"; Sogo Denshi Shuppan; 1990; pp. 239-243./Partial translation-Discussed in the specification.
Office Action of corresponding Japanese Application No. 2002-255644 dated Oct. 30, 2006, with English summary.
Partial English translation of Japanese Application Hei 07-336113, dated Dec. 22, 1995, which is already of record.
Office Action in counterpart Japanese Application No. 2002-255644, and English summary, Mar. 27, 2007.

* cited by examiner

*Primary Examiner*—Benny T. Lee
(74) *Attorney, Agent, or Firm*—Kratz, Quintos & Hanson, LLP

(57) ABSTRACT

A dielectric waveguide which comprises a first single crystal magnesium oxide block having a surface of face (001), (100) or (010) and a first copper oxide superconducting film formed on the above-described surface in a c-axis crystal orientation perpendicular to the surface, and a method of production thereof are provided.

12 Claims, 5 Drawing Sheets

DIELECTRIC WAVEGUIDE HAVING A 45° FACE AND METHOD OF PRODUCTION THEREOF

CROSS-REFERENCE TO RELATED APPLICATIONS

This application is based upon and claims the benefit of priority from the prior Japanese Patent Application No. 2002-255644, filed on Aug. 30, 2002, the entire contents of which are incorporated herein by reference.

BACKGROUND OF THE INVENTION

1. Field of the Invention

The present invention relates to a dielectric waveguide and a method of production thereof to transmit a high-frequency electric signal such as a microwave, quasi-millimeter wave, millimeter wave, sub-millimeter wave, and so on.

2. Description of the Related Art

In a frequency band around a millimeter wave, a circuit using a waveguide, namely, a microwave transmission circuit is often used. Generally, the waveguide can be made small in sectional size with increase of the frequency, based on ½ wavelength as a standard. Further, it is known that it is possible to make the size inside the waveguide as small as $\in_r^{-1/2}$ times by filling a space of the cavity inside the waveguide with a dielectric substance, thus making it a small size. This is called a dielectric waveguide circuit (The basis of microwave circuit and the application thereof p 239–243, by Yoshihiro Konishi, published by Sogo Denshi Shuppan, in 1990). Here, $\in_r$ indicates a relative dielectric constant of the dielectric substance.

In application of these waveguides to a transmission line, a resonator, and so on, signal energy loss in the electromagnetic field causes a problem. Energy loss in an electric conductor and a dielectric material is predominant in the loss described above. Loss in a conductor increases as surface resistance increases, and loss in a dielectric material increases as dielectric loss (tan δ) increases.

A low-loss waveguide using a metal superconductor or an oxide superconductor as a conductor has been researched and developed, and a waveguide type cavity resonator using niobium has become commercially practical in a particle accelerator.

On the other hand, it is known that on the surface of a MgO single crystal (001) (since it is a cubic crystal system, the faces (001), (010), and (100) have substantially the same physical properties), a copper oxide superconducting film being in a strong c-axis crystal orientation is obtained by a plurality of methods such as a sputtering process, a pulse laser deposition (PLD) process and so on. As a method of depositing film, a method can be cited in which the film is deposited under high temperatures of about 600 to 800° C. on a substrate in a reduced oxygen atmosphere. It is known that it is easy to pass a superconductive current along the film surface direction of a c-axis oriented film under a low temperature of the critical temperature Tc or less, compared with an a-axis oriented film. The critical temperature Tc of the copper oxide super conductor is known to be several tens of Kelvins or more, depending on the material.

A waveguide circuit is generally easily made low-loss but easily becomes large in size compared with a planar type circuit such as a microstrip line type, a coplanar type, and so on.

Formation of a super conductive planar type circuit using a substrate on which a copper oxide superconducting film is formed has been researched and developed in many institutions. It is recognized that these circuits can form a low-loss (high unloaded Q) circuit compared with a similar type circuit which uses copper, gold, silver, aluminum or the like which is an ordinary electrically good conductive material as a conductor for a circuit transmission line in a submicro wave and a microwave.

SUMMARY OF THE INVENTION

An object of the present invention is to provide a dielectric waveguide and a method of production thereof to attain small size and low loss (high unloaded Q).

According to an aspect of the present invention, provided is a dielectric waveguide comprising a first single crystal magnesium oxide block having a surface of the face (001), (100) or (010), and a first copper oxide superconducting film formed on the above-described surface in a c-axis crystal orientation perpendicular to the surface and a method of production thereof.

It is possible to provide a small and low-loss (high unloaded Q) dielectric waveguide by forming the first copper oxide superconducting film which is in a c-axis crystal orientation perpendicular to the surface of the first single crystal magnesium oxide block.

DETAILED DESCRIPTION OF THE PREFERRED EMBODIMENTS

First Embodiment

Figure 1:
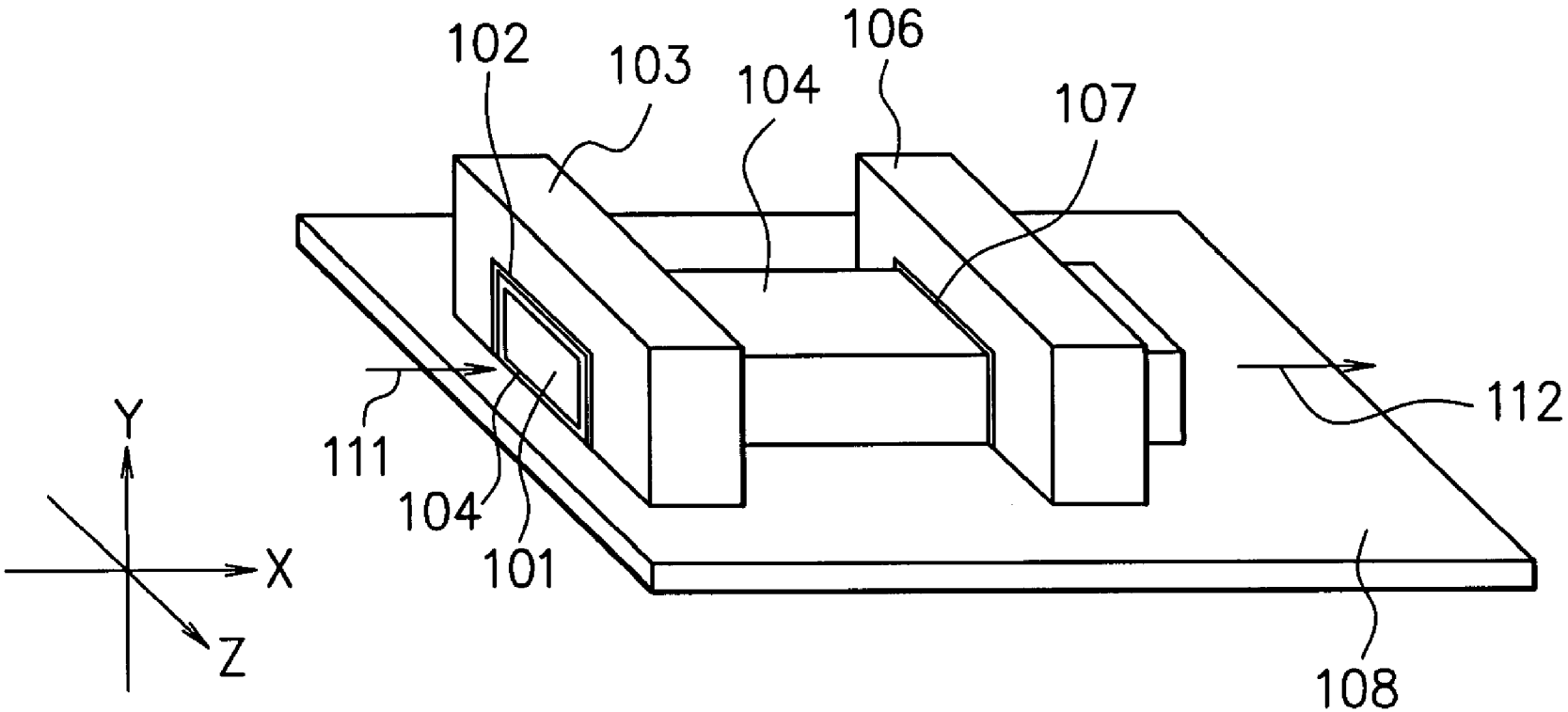
FIG. 1 is a perspective view of a dielectric waveguide according to a first embodiment of the present invention.

FIG. 1 shows a dielectric waveguide according to a first embodiment of the present invention. The dielectric waveguide has a linear transmission line. This dielectric waveguide can transmit a high-frequency electric signal such as a microwave, quasi-millimeter wave, millimeter wave, sub-millimeter wave, and so on.

A single crystal magnesium oxide (MgO) block 101 is a rectangular parallelepiped block consisting of MgO single crystals. Six faces of the MgO block 101 show any crystal orientation face among the faces of (100), (010), or (001). A copper oxide superconducting film 104 is a Gd—BaCu—O material having a main component of $GdBa_2Cu_3O_x$ (x=6.8 to 7.0). The copper oxide superconducting film 104 is formed at a thickness of about 0.8 μm on two XZ faces and two XY faces among six faces of the MgO block 101. At this time, the copper oxide superconducting film 104 is formed so as to have a face in a c-axis crystal orientation perpendicular to the surface of the MgO block 101. The detail will be explained with reference to FIG. 2A to FIG. 2D later.

In the MgO block 101, there are two YZ faces, which define an input port face and an output port face. An input electric signal (electromagnetic wave) 111 is inputted in the input port face, and an output electric signal (electromagnetic wave) 112 is outputted from the output port face. The copper oxide superconducting film 104 is not formed on the input port face and the output port face.

Fixtures 103 and 106 are made of brass and are used to fix (bond) the MgO block 101 on which the copper oxide superconducting film 104 is formed, via indium layers 102 and 107 respectively. A pedestal 108 is a brass plate for fixing the MgO block 101 on which the copper oxide superconducting film 104 is formed. The fixtures 103, 106 are fixed on the pedestal 108 at each two places with screws of M1.2, that is, metric screws having a threaded portion with nominal diameters of 1.2 mm. Through this step, the MgO block 101 on which the copper oxide superconducting film 104 is formed is fixed mechanically on the pedestal 108. The MgO block 101 and the brass members (the fixtures 103, 106 and the pedestal 108) are different in thermal expansion coefficient from each other. Indium layers 102 and 107 which lie between the MgO block and the brass members serve as a buffer to absorb the above-described differences of the thermal expansion coefficient.

When an electromagnetic field signal having a central frequency of 15 GHz and a band of about 1 GHz is allowed to pass through in a $TE_{01}$ mode, if the sizes of the input port face and the output port face of the MgO block 101 are set to about 0.4 cm square, a frequency of a transmission signal becomes equal to a cutoff frequency or more, and such a block is suitable for the present invention. In this case, it does not matter whether the size in the Y direction is the same with the size in the Z direction or not. In the frequency region described above, at the operating temperature of about 70 K, and with the length of the dielectric waveguide to be about 5 to 7 cm, a MgO block 101 having dielectric loss (tan δ) of $10^{-5}$ or less can be used.

As above, according to the present embodiment, at the operating temperature of 70 K, it has an effect of reducing the transmission loss to about ⅓ to 1/10 in a $TE_{01}$ mode compared with a cavity type waveguide made of copper or silver-plated on the inner face thereof at the operating temperature of a room temperature, and an effect of reducing the size of a face perpendicular to the signal transmission direction to about ⅓ to 1/10 compared with an ordinary cavity type waveguide.

Figure 2A:
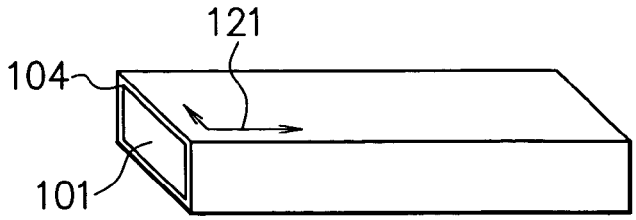
FIG. 2A to FIG. 2D are views showing a copper oxide superconducting film formed on a MgO block.

FIG. 2A shows a method of production of the MgO block 101 on which the copper oxide superconducting film 104 is formed in FIG. 1.

Figure 2B:
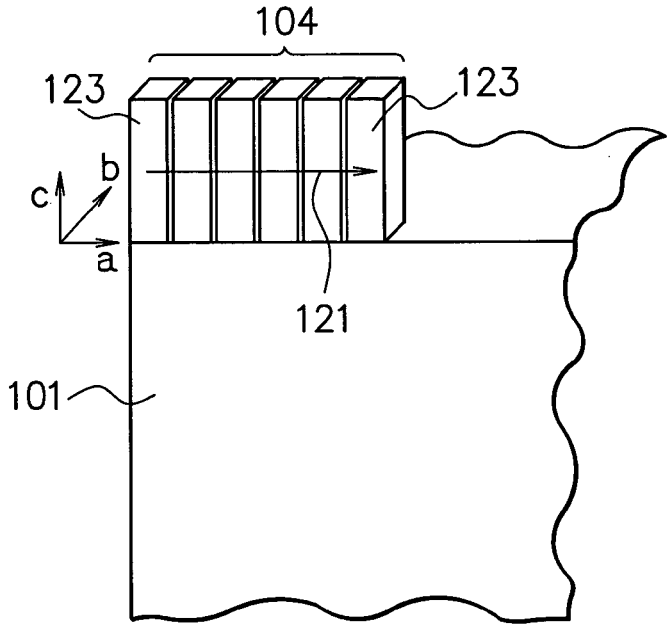

First, the MgO block 101 (e.g., in FIG. 2A) having a surface of (001), (100) or (010) is prepared. As shown in FIG. 2C, a cubic crystal unit cell 122 of the MgO block 101 has the same length of about 4.2 nm for all of the a-axis, b-axis, and c-axis. In this case, the axis length is usually represented by one kind of the axis length. A piece of MgO single crystal is cut in a predetermined direction to form a MgO block 101. Six faces of the MgO block 101 come to any of faces (001), (010) or (100). These faces (001), (010) and (100) have substantially the same physical properties. That is, it is possible to form a copper oxide superconducting film 104 on any face among six faces of the MgO block.

Next, on the surfaces (001), (010) or (100) of the MgO block 101, a copper oxide superconducting film 104 which is in a c-axis crystal orientation perpendicular to the surface is formed by a sputtering process, a pulse laser deposition (PLD) process or the like. For instance, the copper oxide superconducting film 104 can be deposited on the MgO block 101 in an oxygen atmosphere under a reduced pressure at a high temperature environment of about 600 to 800° C.

Figure 2D:
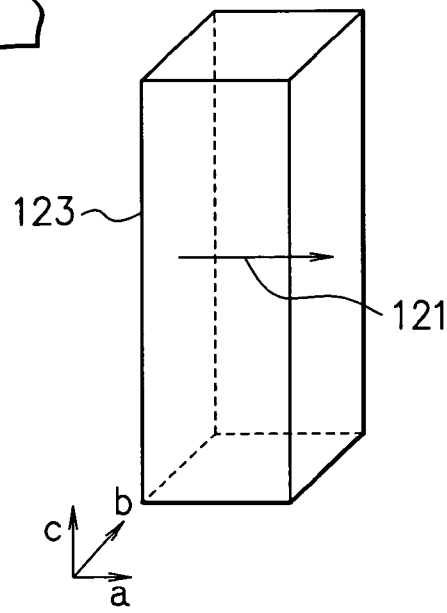
Figure 2C:
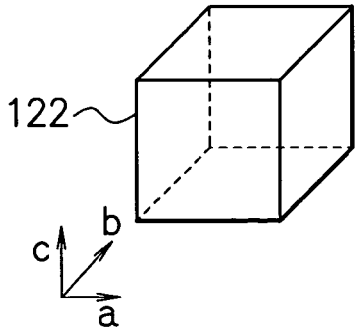

As shown in FIG. 2D, for instance, a unit cell (unit lattice) 123 of the copper oxide superconducting film 104 in a form of $YBa_2Cu_3O_x$ (x=6 to 7) is known to be a tetragonal or rhombic crystal system having a crystal structure anisotropy, and the lengths of the a-axis and the b-axis (that is, lattice constants of a and b) are about 3.8 to 3.9 nm, the length of the c-axis (that is a lattice constant of c) is about 11 to 12 nm. The lengths of the a-axis and b-axis in a unit cell of a tetragonal crystal system are the same. The length of the a-axis and the length of the b-axis in a rhombic crystal system are different a little with each other. It is also known that the unit cell 123 has a property of a super conductive current 121 being easy to flow in the direction perpendicular to the c-axis.

As shown in FIG. 2B, on any surface of (001), (010) or (100) of the MgO block 101, the unit cell 123 of the copper oxide superconducting film 104 which is in a c-axis crystal orientation perpendicular to the surface is formed. Since the lengths of the a-axis and the b-axis of the unit cell 122 of the MgO block 101 (about 4.2 nm) and the lengths of the a-axis and the b-axis of the unit cell 123 of the copper oxide superconducting film 104 (about 3.8 to 3.9 nm) are close in value to each other, it is advantageous to epitaxial growth so far as matching of the crystal lattices is concerned, and it is known that on the surface of the MgO block 101, the copper oxide superconducting film 104 which is in a c-axis orientation to the surface is easy to perform epitaxial growth. By orienting the copper oxide superconducting film 104 in the c-axis direction, the super conductive current 121 can be made easier to flow compared with the case of the a-axis orientation. Thus, as shown in FIG. 2A, the super conductive current 121 can be allowed to flow effectively in the copper oxide superconducting film 104.

Second Embodiment

Figure 3:
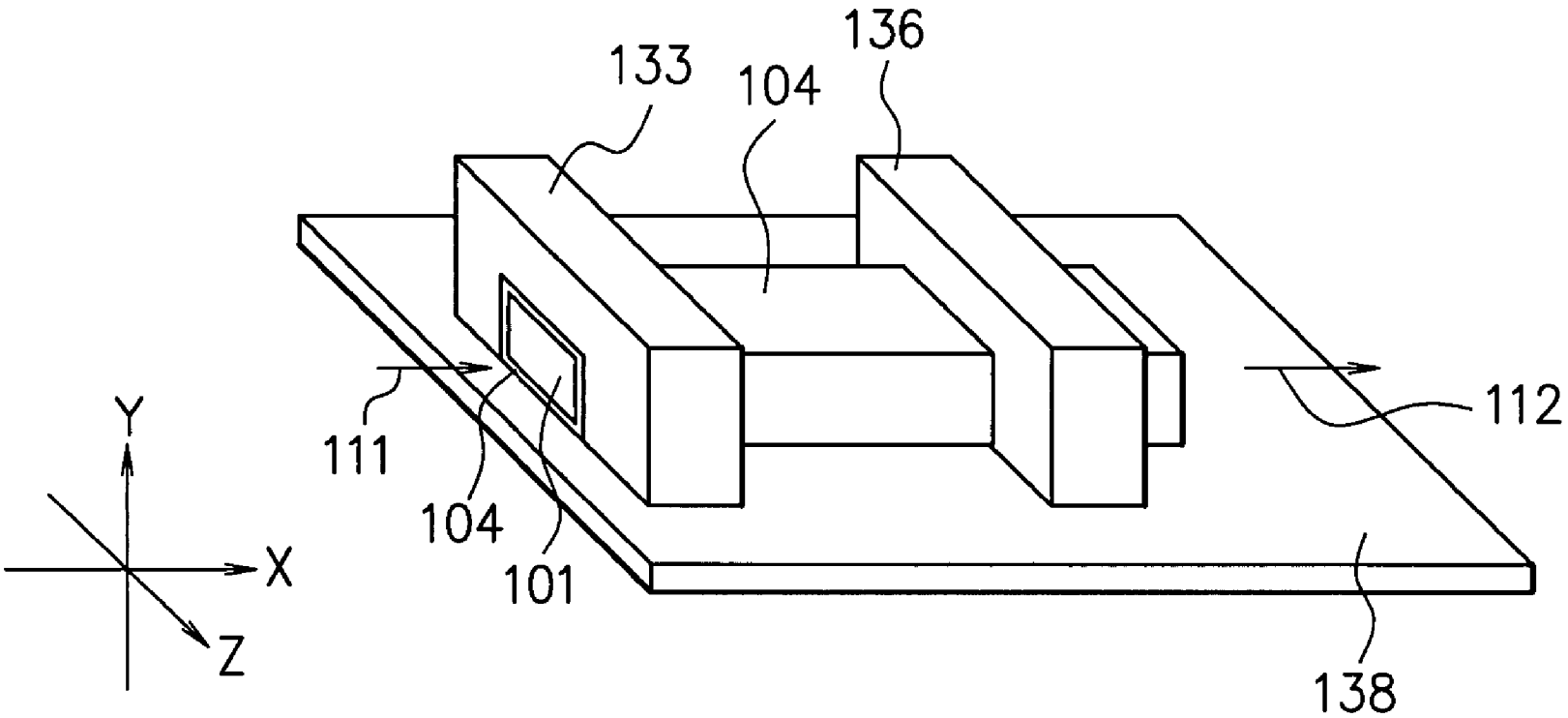
FIG. 3 is a perspective view of a dielectric waveguide according to a second embodiment of the present invention.

FIG. 3 shows a dielectric waveguide according to the second embodiment of the present invention. The difference between the dielectric waveguide of the second embodiment and the dielectric waveguide of the first embodiment (FIG. 1) will be explained below. Other points are the same, and X, Y and Z reference axes are included in the same manner as in FIG. 1. Indium 102 and 107 are provided as a buffer in the dielectric waveguide in FIG. 1. However, a buffer is not used in the dielectric waveguide in FIG. 3.

Fixtures 133 and 136 are bonded directly to the copper oxide superconducting film 104. A pedestal 138 is also bonded directly to the copper oxide superconducting film 104. The thermal expansion coefficient of materials used in the fixtures 133, 136 and the pedestal 138 is close to that of the MgO block 101, and the material of the fixtures and the pedestal are KOVAR, Invar, sintered magnesium oxide, stabilized zirconia, partially stabilized zirconia, and so on. Further, as material for the fixtures 133, 136 and the pedestal 138, polytetrafluoroethylene (PTFE), ethylene tetrafluoroethylene (ETFE) and the like can be used, which are deformable at a temperature of 100 K or less.

As described above, the fixtures 133, 136 and the pedestal 138 are used for fixing the MgO block 101 on which the copper oxide superconducting film 104 is formed, and a portion to make close contact directly with the copper oxide superconducting film 104 is preferably comprised of any one or more kinds of Fe—Ni-based alloys with low thermal coefficient for a metal, such as KOVAR, Invar and the like, sintered magnesium oxide, stabilized zirconia, partially stabilized zirconia, and PTFE, ETFE which are deformable even at 100 K or less.

Third Embodiment

Figure 4:
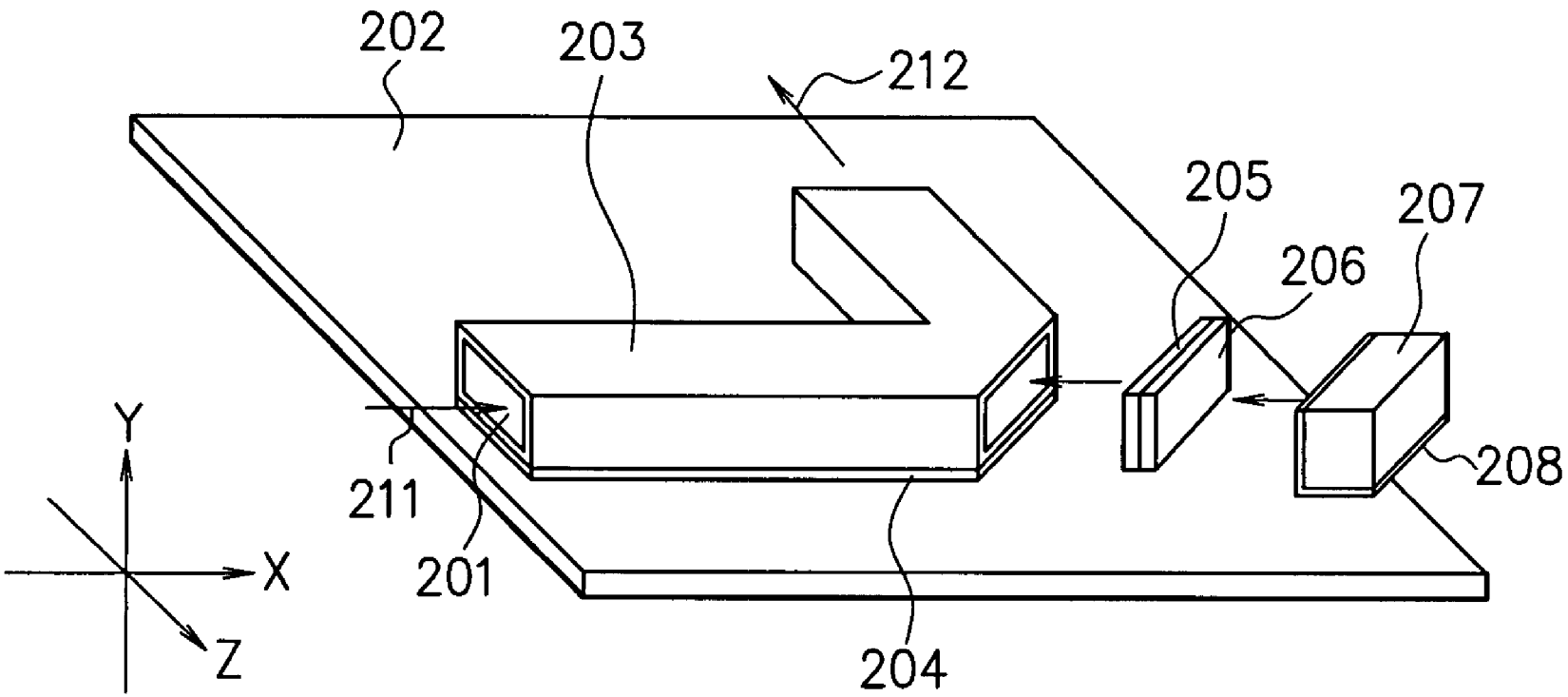
FIG. 4 is a perspective view of a dielectric waveguide having a 45 degrees oriented structure according to a third embodiment of the present invention.

FIG. 4 shows a dielectric waveguide having a 45° oriented structure according to the third embodiment of the present invention. The dielectric waveguide has a transmission line having a 45° oriented structure including a portion bent at a right angle. A single crystal MgO block 201 is a rectangular parallelepiped block which is bent at a right angle, and has a face oriented at 45 degrees to the XY face and YZ face, and oriented at 90 degrees to the XZ face. Hereinafter, this face is called a 45 degrees oriented face. In the surfaces of the MgO block 201, each face of the XY face, XZ face and YZ face is any crystal orientation face among (100), (010) or (001). An input electric signal (electromagnetic wave) 211 is inputted in the input port face, and an output electric signal (electromagnetic wave) 212 is outputted from the output port face. The 45 degrees oriented faces are crystal orientation faces (011), (101) or (110).

In the MgO block 201 surfaces, copper oxide superconducting films 203 are formed on the XY face, XZ face and YZ face except for an input port face and an output port face. Main component of the copper oxide superconducting film 203 is a Y—Ba—Cu—O series substance consisting of $YBa_2Cu_3O_x$ (x=6.8 to 7.0), and the copper oxide superconducting film 203 is formed to have a c-axis crystal orientation perpendicular to the face of the MgO block 201. The thickness of the copper oxide superconducting film 203 is, for instance, about 0.6 μm.

A pedestal 202 is a sintered MgO substrate of purity 99% or more to fix a waveguide (the MgO block 201 on which the copper oxide superconducting film 203 is formed). A bonding film 204 is formed by sintering a silver paste consisting of an organic substance which does not contain a glass frit having $SiO_2$, PbO, $Al_2O$ and so on as a main component which are often used as a glass component, and a silver powder (average particle size of 0.5 μm to 5 μm). After forming the copper oxide superconducting film 203 on the MgO block 201, the silver paste is coated at the thickness of about 30 μm on the opposing faces of the copper oxide superconducting film 203 and the pedestal 202. Then, after the waveguide 201, 203 and the pedestal 202 are put together and dried, the bonding film 204 composed of the silver paste is formed by sintering in an oxidation atmosphere (in the atmospheric condition or in oxygen atmosphere) at 800° C. or more. Thereby, the waveguides 201, 203 are fixed on the pedestal 202. When a silver paste contains a glass frit consisting of $SiO_2$, PbO, $Al_2O$ and so on as a main component, it is not preferable because the above-described glass frit reacts with the copper oxide superconducting film 203, and often damages the super conductive characteristics On the other hand, since the above described silver paste which does not contain a glass frit is hard to react with the copper oxide superconducting film 203 during sintering, it is preferable that it can maintain the super conductive characteristics as a result.

Further, the main component of a copper oxide superconducting film 205 is a Y—Ba—Cu—O series substance consisting of $YBa_2Cu_3O_x$ (x=6.8 to 7.0), and the film is formed on a single crystal MgO block 206. The MgO block 206 has a surface of face (001), (100) or (010). The copper oxide superconducting film 205 is formed on the (001), (100) or (010) surface of the MgO block 206 in a form of a c-axis crystal orientation perpendicular to the face. The area of the copper oxide superconducting film 205 corresponds to the area on the 45 degrees oriented face of the MgO block 201. The copper oxide superconducting film 205 comes into contact with the 45 degrees oriented face of the MgO block 201 and is fixed by the following method.

First, a bonding film 208 made of a silver paste of the same kind as that described above is applied on the bottom face and the left side face of a sintered MgO block 207 at the thickness of about 30 μm. Next, the MgO block 207 and the MgO block 201 are brought into intimate contact with each other, sandwiching therebetween the MgO block 206 on which the copper oxide superconducting film 205 is formed, and fixed with a fixing jig. After being dried in a state of being fixed, the bonding film 208 composed of the silver paste is formed by sintering in an oxidation atmosphere (in the atmospheric condition or in oxygen atmosphere) at a temperature of 800° C. or higher, and fixed. The bonding film 208 bonds between the MgO block 207 and the pedestal 202, and bonds between the MgO block 207 and the MgO block 206. Thereby, the copper oxide superconducting film 205 comes in contact with the 45 degrees oriented face of the MgO block 201 and is fixed.

The MgO block 201 has a 45 degrees oriented face. The 45 degrees oriented face has a surface of (011), (101) or (110), and it is difficult to realize epitaxial growth of a copper oxide superconducting film on this surface. Accordingly, a dielectric waveguide having a 45 degrees oriented structure is formed by allowing the copper oxide superconducting film 205 to come into close contact with the 45 degrees oriented face mechanically, as described above.

When an electromagnetic field signal having a central frequency of 40 GHz and a band of about 1 GHz is allowed to pass through in a $TE_{01}$ mode and when the sizes of an input port face and an output port face of the MgO block 201 are about 0.15 cm square, the frequency of the transmission signal becomes the cut off frequency or more, and it becomes usable. In this case, it does not matter whether the size in the Y direction is the same with the size in the Z direction or not. In the frequency region described above, when a MgO crystal is selected as the dielectric substance among a dielectric substance having an operating temperature of about 60 K, and length of a dielectric waveguide in the range of about 5 to 7 cm, a MgO block having dielectric loss (tan δ) of about $10^{-4}$ to $10^{-5}$ can be used As above, according to the present embodiment, it has effect of reducing the transmission loss to about ½ to 1/10 in a $TE_{01}$ mode at an operating temperature of 60 K compared with a cavity type waveguide made of copper or silver-plated on the inner face thereof in operation at a room temperature, and of reducing the area of the face perpendicular to the signal transmission direction to about 1/9 to 1/10 compared with an ordinary cavity type waveguide.

Figure 5:
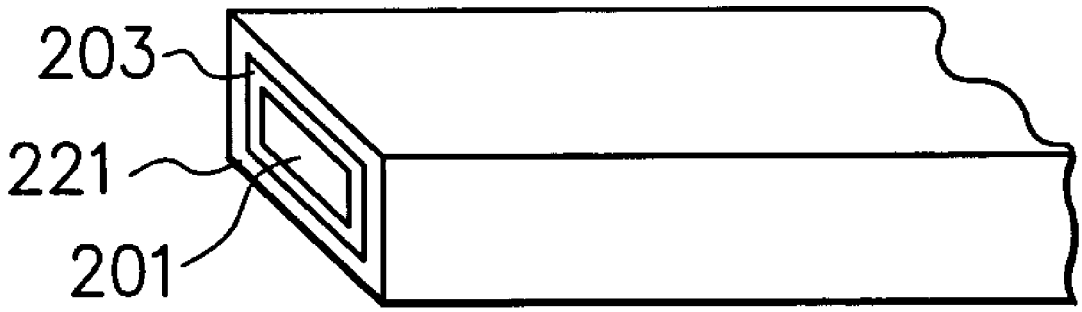
FIG. 5 is a view showing a protective film of the waveguide.

It should be noted that though the silver paste 204 is provided as a bonding film to bond the pedestal 202 and the waveguide 201, 203, as shown in FIG. 5, a silver paste 221 may be provided so as to cover the surface of the copper oxide superconducting film 203 on the MgO block 201. The silver paste 221 has a function as a protective film while handling of the copper oxide superconducting film 203 other than a function as a bonding film. The silver paste 221 can be formed as a protective film by coating, drying, and sintering in the above-described manner. In the waveguide in the first and the second embodiment, a protective film can be formed in the same manner.

According to the above-described first to third embodiments, on the surface (001), (100) or (010) of the MgO block, the copper oxide superconducting film which is in a c-axis crystal orientation perpendicular to the surface is formed. The dielectric waveguide is a waveguide composed of a MgO block as a dielectric and a copper oxide superconducting film as a conductor film, and the cross section perpendicular to the signal transmission direction is a rectangle or a square. For instance, at an operating temperature of 70 K, with a frequency in a 20 GHz band of a submillimeter wave, the transmission loss can be reduced to about one in several compared with a copper-made waveguide operating at a room temperature and the area of the face perpendicular to the signal transmission direction can be reduced to about 1/9 to 1/10 compared with an ordinary cavity type waveguide. That is, it is possible to provide a small and low-loss (high unloaded Q) dielectric waveguide.

The above-described copper oxide superconducting film is preferably an oxide high-temperature superconductor composed of any one kind or more showing the crystal structure anisotropy of $Bin_{n1}Sr_{n2}Ca_{n3}Cu_{n4}O_{n5}$ ($1.8 \leqq n1 \leqq 2.2$, $1.8 \leqq n2 \leqq 2.2$, $0.9 \leqq n3 \leqq 0.2$, $1.8 \leqq n4 \leqq 2.2$, $7.8 \leqq n5 \leqq 8.4$), $Pb_{k1}Bi_{k2}Sr_{k3}Ca_{k4}Cu_{k5}O_{k6}$ ($1.8 \leqq k1+k2 \leqq 2.2$, $0 \leqq k1 \leqq 0.6$, $1.8 \leqq k3 \leqq 2.2$, $1.8 \leqq k4 \leqq 2.2$, $1.8 \leqq k5 \leqq 2.2$, $9.5 \leqq k6 \leqq 10.8$), $Y_{m1}Ba_{m2}Cu_{m3}O_{m4}$ ($0.5 \leqq m1 \leqq 1.2$, $1.8 \leqq m2 \leqq 2.2$, $2.5 \leqq m3 \leqq 3.5$, $6.6 \leqq m4 \leqq 7.0$), $RE_{p1}Ba_{p2}Cu_{p3}O_{p4}$ (RE: consisting of any of La, Nd, Sm, Eu, Gd, Dy, Ho, Er, Tm, Yb, Lu among rare-earth elements, $0.5 \leqq m1 \leqq 1.2$, $1.8 \leqq m2 \leqq 2.2$, $2.5 \leqq m3 \leqq 3.5$, $6.6 \leqq m4 \leqq 7.0$).

As explained above, it is possible to provide a small and low-loss (high unloaded Q) dielectric waveguide by forming a first copper oxide superconducting film being in a c-axis crystal orientation perpendicular to the surface of a first single crystal magnesium oxide block.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

What is claimed is:

1. A dielectric waveguide, comprising:

a first single crystal magnesium oxide block having an input face of orientation (001), (100) or (010), and having other faces each of orientation (001), (100) or (010);

a first copper oxide superconducting film disposed on each of said other faces of said first single crystal magnesium oxide block in a c-axis crystal orientation perpendicular to the face of said block on which it is disposed;

a second single crystal magnesium oxide block having a face of orientation (001), (100) or (010); and a second copper oxide superconducting film disposed on said face of said second single crystal magnesium oxide block in a c-axis crystal orientation perpendicular to said face of said second single crystal magnesium oxide block, wherein said first single crystal magnesium oxide block has a further face oriented at a 45 degree angle to said input face, so that the further face has orientation (011), (101) or (110), and said second copper oxide superconducting film comes in contact with said further face oriented at a 45 degree angle of said first single crystal magnesium oxide block.

2. The dielectric waveguide according to claim 1, further comprising:

a pedestal to fix said first single crystal magnesium oxide block on which said first copper oxide superconducting film is disposed; and a bonding layer to bond said first copper oxide superconducting film to said pedestal.

3. The dielectric waveguide according to claim 2, wherein said bonding layer is a silver paste containing a silver powder and an organic substance which does not contain a glass frit.

4. The dielectric waveguide according to claim 3, wherein said pedestal is a sintered magnesium oxide plate.

5. The dielectric waveguide according to claim 1, further comprising: a bonding film provided on said first copper oxide superconducting film, and consisting of one and more kinds of the bond material that is an indium or a silver paste containing an organic substance not containing a glass frit, and a silver powder.

6. The dielectric waveguide according to claim 1, further comprising: a protective film containing silver disposed on the surface of said first copper oxide superconducting film.

7. The dielectric waveguide according to claim 1, further comprising a pedestal to fix said first single crystal magnesium oxide block on which said first copper oxide superconducting film is disposed.

8. The dielectric waveguide according to claim 7, wherein said first single crystal magnesium oxide block is fixed mechanically on said pedestal.

9. The dielectric waveguide according to claim 1, wherein said first and second copper oxide superconducting films are oxide high-temperature superconductor composed of one or more compounds showing crystal structure anisotropy selected from the group consisting of $Bi_{n1}Sr_{n2}Ca_{n3}Cu_{n4}O_{n5}$ ($1.8 \leqq n1 \leqq 2.2$, $1.8 \leqq n2 \leqq 2.2$, $0.9 \leqq n3 \leqq 1.2$, $1.8 \leqq n4 \leqq 2.2$, $7.8 \leqq n5 \leqq 8.4$), $Pb_{k1}Bi_{k2}Sr_{k3}Ca_{k4}Cu_{k5}O_{k6}$ ($1.8 \leqq k1+k2 \leqq 2.2$, $0 \leqq k1 \leqq 0.6$, $1.8 \leqq k3 \leqq 2.2$, $1.8 \leqq k4 \leqq 2.2$, $1.8 \leqq k5 \leqq 2.2$, $9.5 \leqq k6 \leqq 10.8$), $Y_{m1}Ba_{m2}Cu_{m3}O_{m4}$ ($0.5 \leqq m1 \leqq 1.2$, $1.8 \leqq m2 \leqq 2.2$, $2.5 \leqq m3 \leqq 3.5$, $6.6 \leqq m4 \leqq 7.0$), $RE_{p1}Ba_{p2}Cu_{p3}O_{p4}$ (RE: consisting of any of La, Nd, Sm, Eu, Gd, Dy, Ho, Er, Tm, Yb, Lu among rare-earth elements, $0.5 \leqq p1 \leqq 1.2$, $1.8 \leqq p2 \leqq 2.2$, $2.5 \leqq p3 \leqq 3.5$, $6.6 \leqq p4 \leqq 7.0$).

10. The dielectric waveguide according to claim 1, wherein said first copper oxide superconducting film is an oxide high-temperature superconductor comprising a compound showing crystal structure anisotropy selected from the group consisting of $Bi_{n1}Sr_{n2}Ca_{n3}Cu_{n4}O_{n5}$ ($1.8 \leqq n1 \leqq 2.2$, $1.8 \leqq n2 \leqq 2.2$, $0.9 \leqq n3 \leqq 1.2$, $1.8 \leqq n4 \leqq 2.2$, $7.8 \leqq n5 \leqq 8.4$), $Pb_{k1}Bi_{k2}Sr_{k3}Ca_{k4}Cu_{k5}O_{k6}$ ($1.8 \leqq k1+k2 \leqq 2.2$, $0 \leqq k1 \leqq 0.6$, $1.8 \leqq k3 \leqq 2.2$, $1.8 \leqq k4 \leqq 2.2$, $1.8 \leqq k5 \leqq 2.2$, $9.5 \leqq k6 \leqq 10.8$), $Y_{m1}Ba_{m2}Cu_{m3}O_{m4}$ ($0.5 \leqq m1 \leqq 1.2$, $1.8 \leqq m2 \leqq 2.2$, $2.5 \leqq m3 \leqq 3.5$, $6.6 \leqq m4 \leqq 7.0$), and $RE_{p1}Ba_{p2}Cu_{p3}O_{p4}$ (RE: consisting of any of La, Nd, Sm, Eu, Gd, Dy, Ho, Er, Tm, Yb, Lu among rare-earth elements, $0.5 \leqq p1 \leqq 1.2$, $1.8 \leqq p2 \leqq 2.2$, $2.5 \leqq p3 \leqq 3.5$, $6.6 \leqq p4 \leqq 7.0$).

11. A method of production for a dielectric waveguide comprising:

a step of preparing a first single crystal magnesium oxide block having an input face of orientation (001), (100) or (010) and having other faces each of orientation (001), (100) or (010);

a step of forming a first copper oxide superconducting film on four or more of said other faces in a c-axis crystal orientation perpendicular to the face of said block on which it is disposed;

a step of preparing a second single crystal magnesium oxide block having a face of orientation (001), (100) or (010); and a step of forming a second copper oxide superconducting film disposed on said face of said second single crystal magnesium oxide block in a c-axis crystal orientation perpendicular to said face of said second single crystal magnesium oxide block, wherein said first single crystal magnesium oxide block has a further face oriented at a 45 degree angle to said input face, so that the further face has orientation (011), (101) or (110), and said second copper oxide superconducting film comes in contact with said further face oriented at a 45 degree angle of said first single crystal magnesium oxide block.

12. The method of production for the dielectric waveguide according to claim 11, wherein said step of forming a first copper oxide superconducting film comprises forming the first copper oxide superconducting film by a sputtering process or a pulse laser deposition process.

* * * * *